US008999138B2

(12) United States Patent
Ellis

(10) Patent No.: US 8,999,138 B2
(45) Date of Patent: Apr. 7, 2015

(54) ANODIC DEVICES AND METHODS FOR REDUCING CORROSION

(75) Inventor: Walter B. Ellis, Jupiter, FL (US)

(73) Assignee: RGF Environmental Group, Inc., Riviera Beach, FL (US)

( * ) Notice: Subject to any disclaimer, the term of this patent is extended or adjusted under 35 U.S.C. 154(b) by 495 days.

(21) Appl. No.: 13/304,454

(22) Filed: Nov. 25, 2011

(65) Prior Publication Data

US 2013/0134054 A1 May 30, 2013

(51) Int. Cl.
*C23F 13/00* (2006.01)
*C23F 13/10* (2006.01)

(52) U.S. Cl.
CPC ..... *C23F 13/10* (2013.01); *C23F 2213/32* (2013.01)

(58) Field of Classification Search
CPC ..... C23F 13/00; C23F 13/005; C23F 13/02; C23F 13/06; C23F 13/08; C23F 13/10; C23F 2213/30; C23F 13/16; C23F 13/18; C23F 13/20; C23F 2213/32
USPC ..... 205/724, 735, 736, 740; 204/196.01, 204/196.3, 196.37
See application file for complete search history.

(56) References Cited

U.S. PATENT DOCUMENTS 5,930,113 A * 7/1999 McCann ..... 361/704

OTHER PUBLICATIONS

Unknown, Martyr The world's premium marine anodes, Aug. 2008, www.martyranodes.com.†
Ronald McLaughlin, Corrosion Grenade, entire website, Nov. 2006, www.corrosiongrenade.com.†
Ronald McLaughlin, The Corrosion Grenade, p. 6B, May 2009, Florida HVAC Insider.†

* cited by examiner
† cited by third party

*Primary Examiner* — Luan Van
*Assistant Examiner* — Alexander W Keeling
(74) *Attorney, Agent, or Firm* — Rothwell, Figg, Ernst & Manbeck, P.C.

(57) ABSTRACT

The present invention includes an anodic device for reducing corrosion adapted to reduce corrosion of an object subject to corrosion having a base with a thickness and surface area, and a plurality of protrusions protruding from the base each having a thickness and surface area, wherein the device is configured to allow a current to flow between the device and the object subject to corrosion. The present invention also includes methods associated with the use of such devices.

4 Claims, 8 Drawing Sheets

ANODIC DEVICES AND METHODS FOR REDUCING CORROSION

FIELD OF THE INVENTION

The present invention relates to anodic devices and methods for the protection of objects subject to corrosion.

BACKGROUND OF THE INVENTION

Commercial and residential HVAC systems, air conditioning systems, PTAC Units, chiller systems, systems utilizing liquid refrigerant, systems utilizing cooling solution, and other related systems, typically contain internal and external metallic components, comprised of, for example, aluminum, aluminum alloy, copper, copper alloy and other metals and metal alloys. The function of such systems and the environments in which such systems are used will often create a situation where water from the air and environment will condense on and/or coat the surface of the internal and external metallic components.

In HVAC systems, for example, extremely cold refrigerants typically travel through metal piping or "lines" internal and external to a given system making the piping cold as well. The difference between the temperature of the piping and the ambient temperature will often cause water to collect on the surface of the piping through condensation. Similarly, flat metal "fins," for example, used for heat transfer in such systems are often comprised of aluminum or aluminum alloys. The fins of such systems can also be colder than ambient temperature, thereby also collecting condensation on their surfaces. The collection of water on the surface of metal piping, fins and other internal and external metal components of a given system, along with other factors, can greatly increase the risk of corrosion of such metallic components.

Substances other than water can cause corrosion as well, including formicary corrosion caused by volatile organic compounds ("VOCs") contained in building materials. For example, VOCs can emit from building materials and enter into and circulate through HVAC systems, then come into contact with and corrode essential metal components of HVAC systems.

In many cases, corrosion of internal and external metal components can cause premature replacement of entire systems due to failure of critical components. Moreover, corrosion of critical metal components, such as piping carrying Freon, Ammonia or other refrigerants, can cause a risk of failure of a given system and potential environmentally hazardous issues as well.

The purpose of the present invention is to reduce corrosion from occurring on metallic components of HVAC systems, air conditioning systems, PTAC Units, chiller systems, systems utilizing liquid refrigerant, systems utilizing cooling solution, and other related systems and related equipment as described herein.

Galvanic anodes have been used within cathodic systems designed to protect metal objects from corrosion. Such galvanic anodes are typically comprised of metals and metal alloys including, but not limited to, zinc alloys, with an electrochemical potential that is more negative than the electrochemical potential of the object subject to corrosion, such objects being typically comprised of metals and metal alloys as well, including, but not limited to, steel, copper, and aluminum. As a result of the difference in electrochemical potential, current flows between the dissimilar metals when the dissimilar metals are in physical contact with each other. Due to the corrosive current flow, corrosion that may otherwise occur on the surface of the object subject to corrosion instead may occur on the galvanic anode, thereby protecting, to some degree, the object subject to corrosion from corrosion.

The anodic objects in the prior art typically take the form of solid spheres, or other solid generic shapes, only providing the source of sacrificial material, when placed in contact with an object subject to corrosion. Such prior art anodic devices can protect an object subject to corrosion to a limited extent. However, the amount of corrosion reduction is minimal and unsatisfactory, and such prior art anodic devices are not designed to maximize in any way the reduction in corrosion in an efficient and cost-effective manner.

As described herein, the anodic devices and methods of reducing corrosion of the present invention constitute a substantial departure from conventional anodic devices. Such prior art devices, as distinguished from the devices and methods of the present invention, are not configured in a manner to, for example, capture condensation and metallic solution to maximize current flow to the sacrificial anode to synergistically reduce corrosion of objects subject to corrosion. Instead, the prior art objects perform the basic function disclosed above, but are inefficient for their purpose particularly since such prior art objects are not designed to utilize condensation and metallic solution or to maximize corrosion current flow, which the devices of the present invention are configured to do.

As described herein, the present invention is therefore a significant advancement in the field of anodic protection because of its unique configurations, including increase in surface area, use of fluid reservoirs, use of protrusions, and use of holes or vertical capillaries, to collect and store condensation from ambient air to maximize the current flow to the sacrificial anodic device and thereby reduce corrosion of objects subject to corrosion.

SUMMARY OF THE INVENTION

Particular embodiments of the present invention provide devices and methods for protecting objects subject to corrosion. In one aspect, a particular anodic device for reducing corrosion adapted to reduce corrosion of an object subject to corrosion is provided. The anodic device has a base. The base has a thickness and a surface area. The device also has a plurality of protrusions protruding from the base. Each of the protrusions has a thickness and a surface area. The device is configured to allow a current to flow between the device and the object subject to corrosion.

In other embodiments of the device, the surface area of the base and the surface area of the protrusions result in the collection of condensation on the surface areas to cause an increase in the current flow between the device and the object subject to corrosion.

In other embodiments of the device, the device is comprised of an anodic material, zinc or zinc alloy, magnesium or magnesium alloy, or aluminum or aluminum alloy.

In other embodiments of the device, the condensation covering the surface area of the device comprises one or more metals to form a metallic solution.

In other embodiments of the device, the device is configured for attachment to an HVAC system, air conditioning system, PTAC Unit, a chiller system, a system utilizing liquid refrigerant or a system utilizing cooling solution.

In other embodiments of the device, the device is configured to reduce corrosion caused by water or by volatile organic compounds.

In another aspect of the present invention, another anodic device for reducing corrosion adapted to reduce corrosion of an object subject to corrosion is provided. The anodic device has a base. The base has a thickness and a surface area. The device also has a plurality of protrusions protruding from the base. Each of the protrusions has a thickness and a surface area. The device also has a plurality of holes extending through the device. Each of the holes is defined by a surface area of the device. The device is configured to allow a current to flow between the device and the object subject to corrosion.

In other embodiments of the device, the surface area of the base, the surface area of the protrusions and the hole surface area result in the collection of condensation on the surface areas and within the reservoir to cause an increase in the current flow between the device and the object subject to corrosion.

In other embodiments of the device, the device is comprised of an anodic material, zinc or zinc alloy, magnesium or magnesium alloy, or aluminum or aluminum alloy.

In other embodiments of the device, the device is configured to collect and store water.

In other embodiments of the device, the condensation collected on the surface areas and within the reservoir of the device comprises one or more metals to form a metallic solution.

In other embodiments of the device, the device is configured to collect and store the metallic solution.

In other embodiments of the device, the device is comprised of one or more vertical capillaries.

In other embodiments of the device, the device is configured for attachment to an HVAC system.

In other embodiments of the device, the device is configured for attachment to an air conditioning system.

In other embodiments of the device, the device is configured for attachment to a PTAC Unit, a chiller system, a system utilizing liquid refrigerant or a system utilizing cooling solution.

In other embodiments of the device, the device is configured to reduce corrosion caused by water or by volatile organic compounds.

In another aspect of the present invention, a method for reducing corrosion of an object subject to corrosion is provided. First, an anodic device with a surface having one or more protrusions is provided; second, the anodic device is placed in electrical communication with an object subject to corrosion; third, collection of water on the surface of the anodic device is facilitated; fourth, flow of current between the object subject to corrosion and the anodic object is facilitated such that the anodic object corrodes more than the object subject to corrosion corrodes.

In other embodiments of the method, the method further comprises facilitating the addition of metal to the water.

In other embodiments of the method, the method further comprises facilitating the creation of a metallic solution contained on the anodic device.

In another aspect of the present invention, a method for reducing corrosion of an object subject to corrosion is provided. First, an anodic device with a surface having one or more protrusions is provided; second, the anodic device is placed in electrical communication with an object subject to corrosion; third, collection of water on the surface of and within the anodic device is facilitated; fourth, flow of current between the object subject to corrosion and the anodic object is facilitated such that the anodic object corrodes more than the object subject to corrosion corrodes.

In other embodiments of the method, the method further comprises facilitating the collection of the water in one or more holes or in one or more reservoirs.

In other embodiments of the method, the method further comprises facilitating the addition of metal to the water.

In other embodiments of the method, the method further comprises facilitating the creation of a metallic solution contained on or in the anodic device.

In yet another aspect of the present invention, one or more methods for reducing corrosion of an object subject to corrosion are provided. In these methods, any or all of the anodic devices described herein are placed in electrical communication with an object subject to corrosion.

Further advantages, characteristic features and the modes of use of embodiments of the present disclosure will become clear from the following detailed description of embodiments thereof, provided solely by way of non-limiting examples. It is also to be understood that the scope of the present disclosure includes all the possible combinations of the embodiments mentioned above and those described with reference to the following detailed description.

The above and other aspects and embodiments are described below with reference to the accompanying drawings.

BRIEF DESCRIPTION OF THE DRAWINGS

The accompanying drawings, which are incorporated herein and form part of the specification, help illustrate various embodiments of the present disclosure and, together with the description, further serve to explain the principles of the invention and to enable a person skilled in the pertinent art to make and use the embodiments disclosed herein. In the drawings, like reference numbers indicate identical or functionally similar elements.

DETAILED DESCRIPTION OF THE INVENTION

Figure 1:
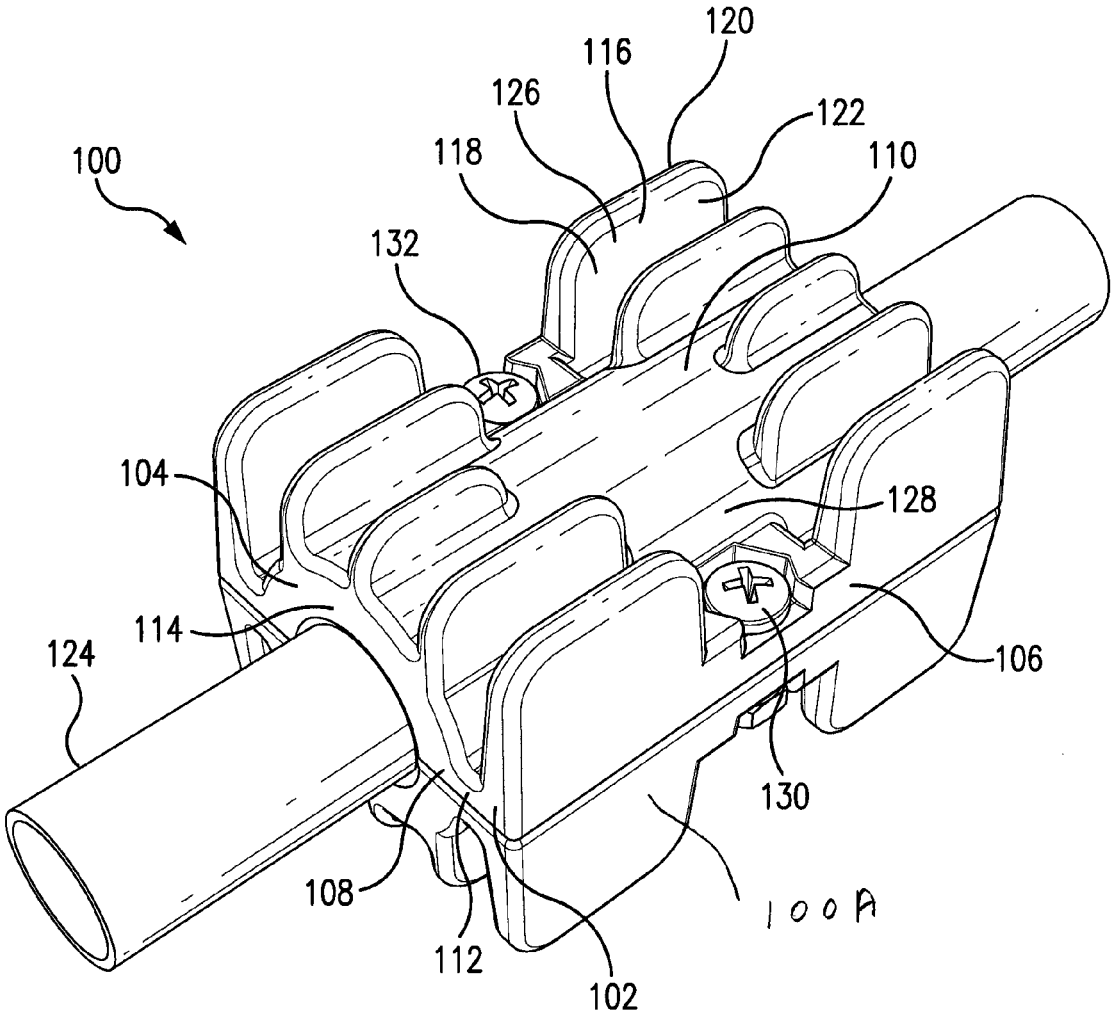
FIG. 1 is a perspective view of an anodic device for reducing corrosion in an object subject to corrosion in accordance with an embodiment of the present invention.

Referring now to the drawings, several embodiments and examples of anodic devices for reducing corrosion of objects subject to corrosion are provided. The devices can be formed of the following materials, including metals and/or metal alloys, such as, for example, zinc or zinc alloy (for use to reduce corrosion of, for example, internal or external metal components of an HVAC system made of aluminum, aluminum alloy, copper and/or copper alloy and subject to corrosion), magnesium or magnesium alloy (for use to reduce corrosion of, for example, internal or external metal components of an HVAC system made of aluminum, aluminum alloy, copper and/or copper alloy and subject to corrosion), and/or aluminum or aluminum alloy (for use to reduce corrosion of, for example, internal or external metal components of an HVAC system made of steel or steel alloy and subject to corrosion). It will be understood by those skilled in the art that the anodic devices disclosed herein can be comprised of numerous other anodic materials, and that the selection of the proper dissimilar anodic materials for the anodic devices would depend on the material or materials that the objects subject to corrosion are made of, such that there is an appropriate difference in electrochemical potential between the anodic devices and the objects subject to corrosion causing the anodic devices to corrode and the corrosion of the objects subject to corrosion to be reduced.

Referring now to FIG. 1, a device 100 for reducing corrosion of objects subject to corrosion is shown. The device 100 has a base portion 102 that is configured to connect to a metallic pipe or "line" 124 on, for example, the suction side of a compressor of an HVAC system. It will be understood that, in this example, the compressor line 124 could be carrying refrigerant and in that case would be very cold as compared to the ambient temperature. It will be further understood that connecting the device 100 to the line 124 would make the device 100 cold as well as a result of conduction with the line 124.

The base 102 of the device 100 has a thickness 104, length 106, width 108, and surface area 110. In this embodiment, the base portion is comprised of a flat portion 112 and an arched portion 114 configured to surround a metallic line 124. The device 100 also has a plurality of protrusions 116 that extend from the base 102. Each of the protrusions 116 has a height 118, thickness or width 120, length 122 and surface area 126. The protrusions 116 on the device 100 greatly enhance the overall surface area and volume of the device 100 in combination with the surface area 110 and volume of the base 102. The increased surface area of the device 128 will cause an overall increase in the ability of condensation to form on the surface of the device 100 in a given application, particularly in the example where the device 100 is placed in contact with a very cold line 124 as compared to the ambient temperature. The protrusions 108 can be elongated or otherwise shaped to increase the surface area available for condensation.

The object subject to corrosion could be the metallic line 124 itself but could also be other internal or external components, or multiple internal or external components, of the HVAC system, and in electrical communication with the device 100 and/or line 124. That is, the device 100, while attached to or otherwise in electrical communication with the exterior line 124, could also be in electrical communication with internal components of the HVAC system that are also in electrical communication with the line 124.

By way of example, as shown in FIG. 1, the device 100 can connect with another virtually identical device 100A to fully surround the metallic line 124 in a collar-like fashion. The devices 100 and 100A may be connected to each other and the line 124 in a multitude of ways, including, but not limited to, with nut and bolt assemblies 130 and 132.

As the device 100 (which is comprised of a metal that is dissimilar to the object or objects subject to corrosion) is placed in electrical communication with the surface of the metallic line 124, a potential difference is created between the dissimilar metals, causing corrosive current to flow to the device 100 from the line 124 and/or objects subject to corrosion within the HVAC system, for example. Due to the unique configuration of the device 100, including its protrusions 116, and the increase in surface area of the overall device 100, condensation collected on the surface of the device 100 is increased, particularly in the event the device is mounted on a line 124 or other surface that is colder than ambient temperature. The increase in condensation causes an increase in the ability of current to flow to the device 100 from the line 124 and/or objects subject to corrosion such that the device 100 corrodes and corrosion of the objects subject to corrosion is reduced. As corrosion of the device 100 continues, metal atoms release from the device 100 and enter the condensation located on the surface of the device 100 and between the device 100 and surface of the line 124, creating a metallic solution that becomes increasingly conductive as the corrosion process continues. This increasingly enhances the current flow to the device 100 from the line 124 and/or objects subject to corrosion, creating a sponge-like effect at the location of the device, thereby maximizing the current flow to the device 100 and overall protection of the objects subject to corrosion.

The configuration of the base 102, base thickness 104, base length 106, base surface area 110, base flat portion 112, base arched portion 114, protrusions 116, protrusion thickness 120, protrusion length 122, protrusion surface area 126 and overall shape and configuration of the entire device 100, and materials used, may be selected according to numerous parameters including, but not limited to, what type of metal the device 100 is being attached to, what type of metal the objects subject to corrosion are made of, the location of the device 100 in relation to the location of the objects subject to corrosion, the environmental conditions, the overall parameters of a given application, the desired life of the device 100, and so forth.

Figure 1A:
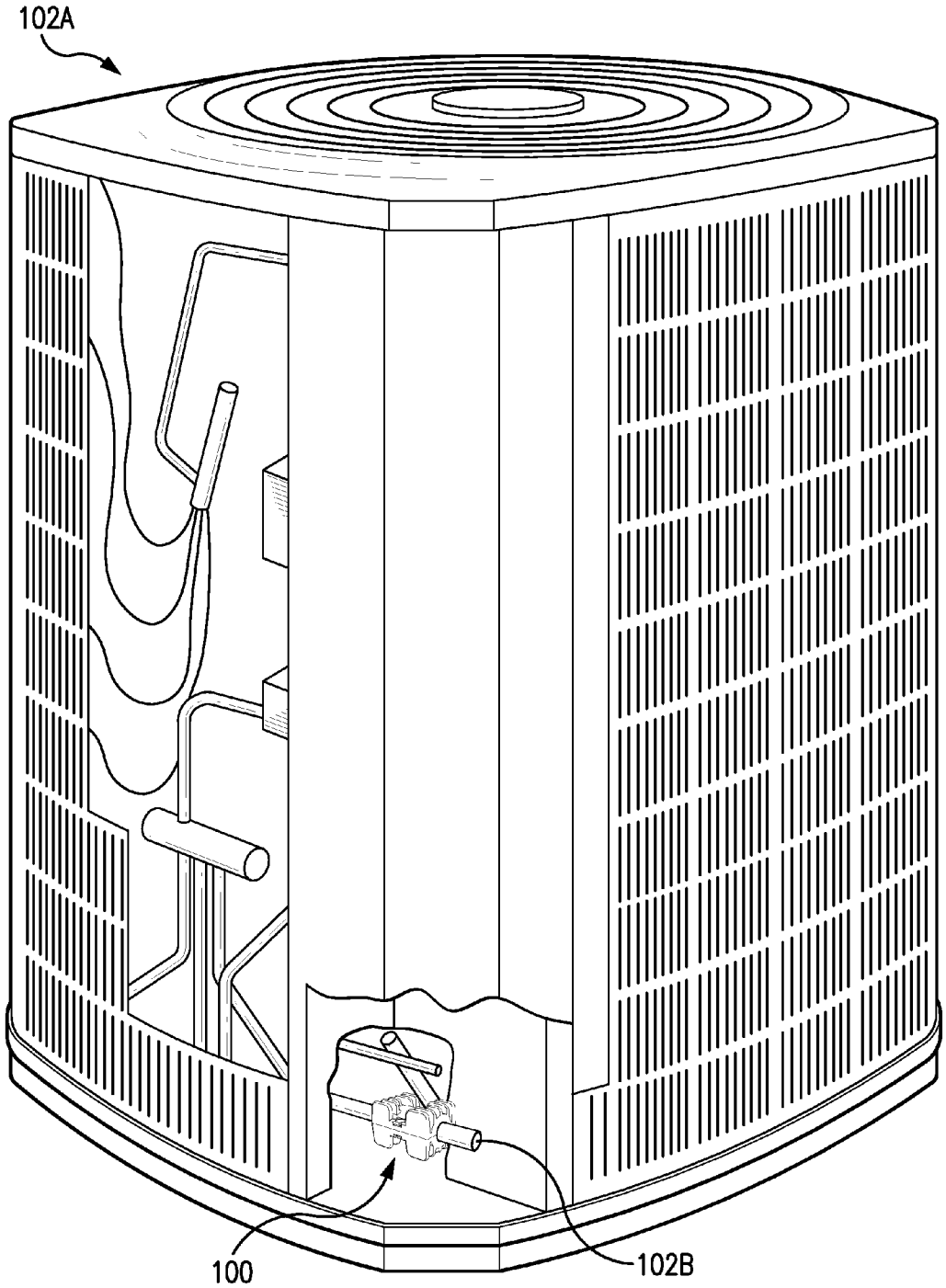
FIG. 1A is a perspective view of the anodic device of FIG. 1 used in conjunction with an HVAC system in accordance with another embodiment of the present invention.
Figure 1B:
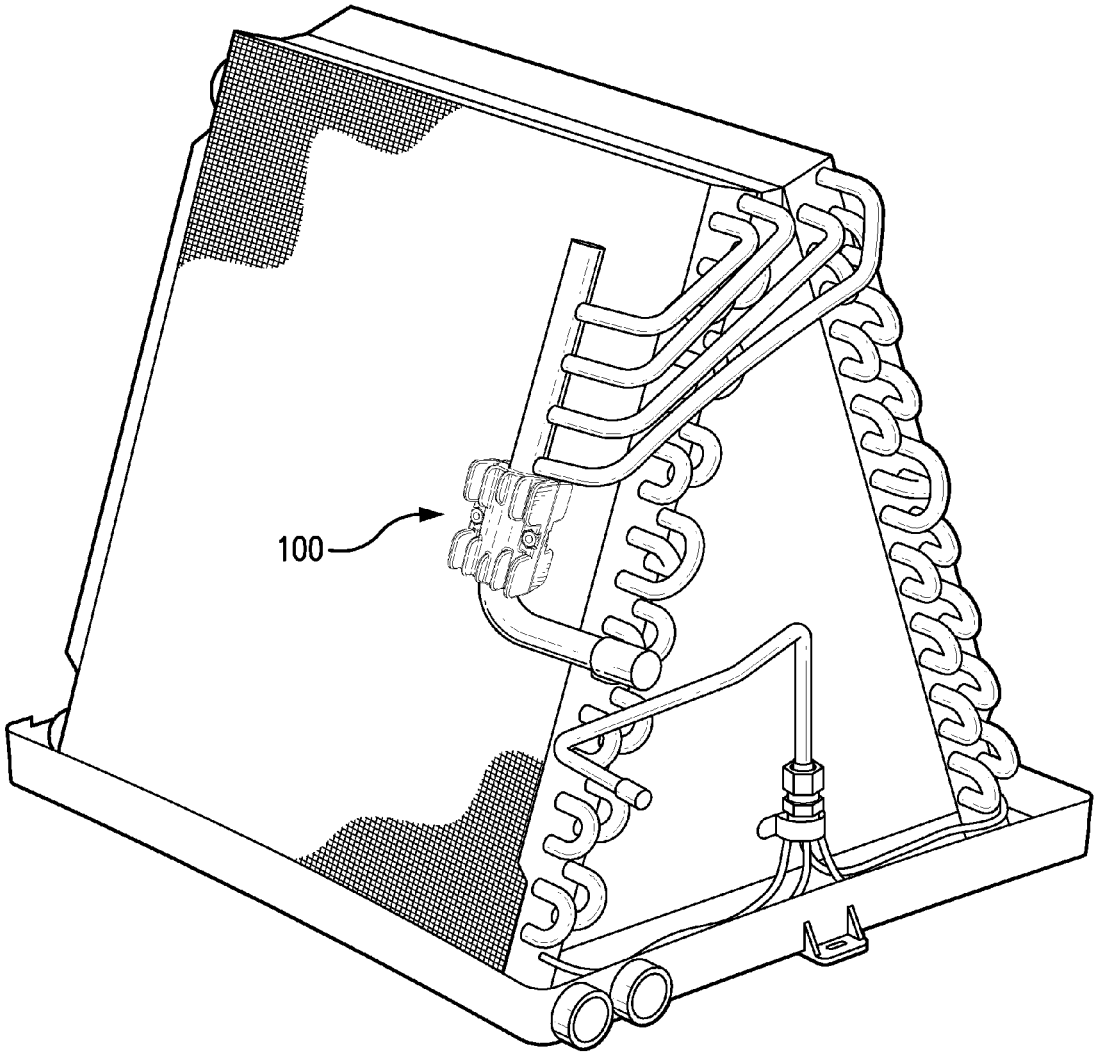
FIG. 1B is a perspective view of the anodic device of FIG. 1 used in conjunction with, and in another location on, an HVAC system in accordance with another embodiment of the present invention.

Referring now to FIG. 1A, the anodic device 100 is shown connected to an HVAC system 102A. The device 100 is secured, through nut and bolt assemblies (not shown), onto the suction line 102B of a compressor contained within the HVAC system 102A. Similarly, as shown in FIG. 1B, the anodic device 100 can be connected to other or additional components within a given system for more precise protection. It will be appreciated that the device 100 can be secured onto other types of HVAC systems, including, but not limited to, air conditioning systems, PTAC Units, chiller systems, cooling towers, systems utilizing liquid refrigerant, systems utilizing cooling solution, marine chiller systems, saltwater flush systems, on-board live holding systems on ships, ship hulls and general marine-based applications, land-based aquaculture applications (including chill systems and grow out tank filtration systems), and other related systems comprising metal components subject to corrosion.

Set forth below are specific examples of configurations of devices 100 according to the present invention. As indicated above, the devices 100 in the following examples could be made of metal or metal alloy, such as zinc, zinc alloy, magnesium, magnesium alloy, aluminum, and/or aluminum alloy. Such materials could include, but are not limited to, MIL-A-19001K ASTM B418 Type I, MIL-A-24779 ASTM B418 Type II, Magnesium ASTM B-843, Zamak 2 ASTM AC43A, Zamak 3 ASTM AG40A, Zamak 4, Zamak 5 ASTM AC41A, Zamak 6 and Zamak 7 ASTM AG40B. Selection of the proper dissimilar anodic metal for the anodic devices would depend on what the objects subject to corrosion are made of, such that there is an appropriate difference in electrochemical potential between the anodic devices and the objects subject to corrosion causing the anodic devices to corrode and the corrosion of the objects subject to corrosion to be reduced.

Examples 1-5

| | Base Thickness | Base Width | Base Length | Arch Diameter | Protrusion Height | Protrusion Thickness | Protrusion Length | Surface Area |
|---|---|---|---|---|---|---|---|---|
| Example 1 | .30" | 1.6" | 3.0" | .375" | .56" | .125" | 1.00" | 23.4 $inch^2$ |
| Example 2 | .25" | 1.6" | 3.0" | .50" | .56" | .125" | 1.10" | 23.6 $inch^2$ |
| Example 3 | .20" | 1.6" | 3.0" | .625" | .56" | .125" | 1.10" | 23.5 $inch^2$ |
| Example 4 | .33" | 2.04" | 3.0" | .75" | .81" | .22" | 1.2" | 28.2 $inch^2$ |
| Example 5 | .33" | 2.04" | 3.0" | .875" | .81" | .22" | 1.2" | 28.2 $inch^2$ |
| Example 6 | .25" | 2.04" | 3.0" | 1.125" | .81" | .22" | 1.2" | 28.2 $inch^2$ |

Figure 2:
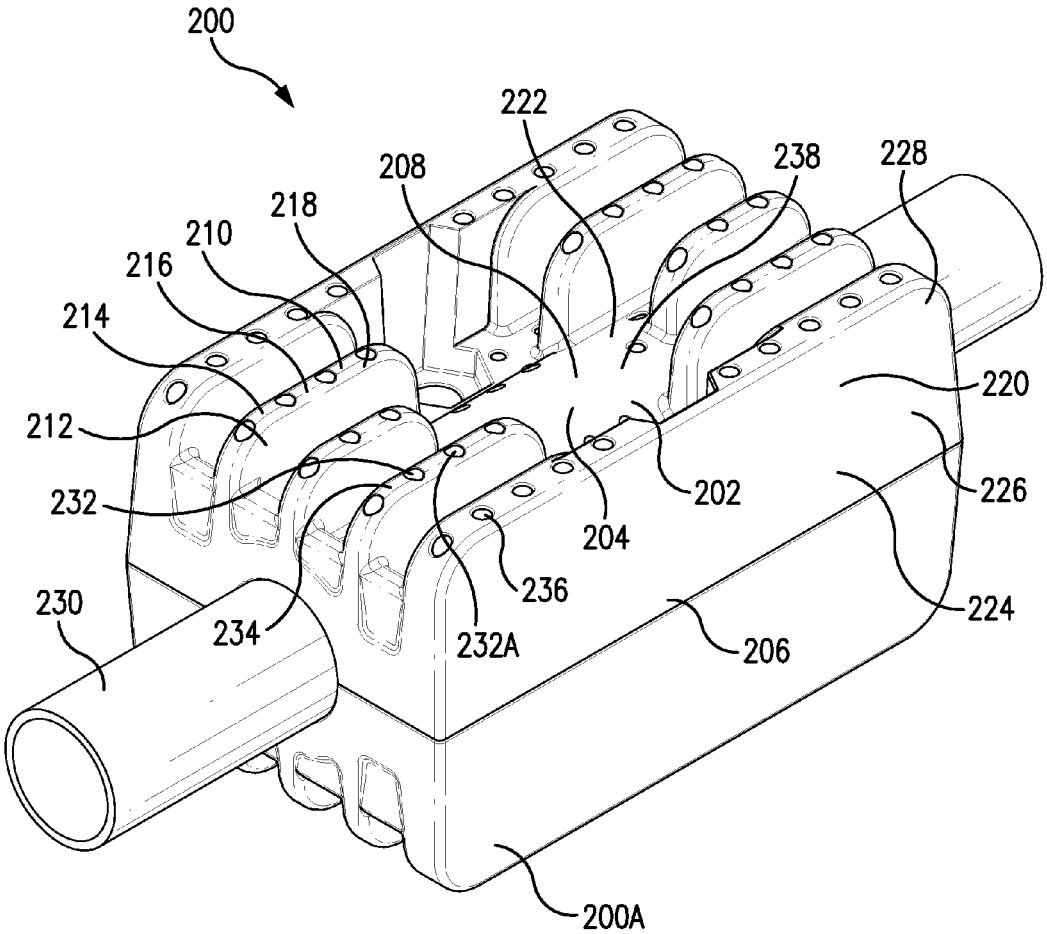
FIG. 2 is a perspective view of an anodic device for reducing corrosion in an object subject to corrosion in accordance with another embodiment of the present invention.

Referring now to FIG. 2, another anodic device 200 for reducing corrosion of objects subject to corrosion is shown. This anodic device 200 is designed with an "arch"-like or "bridge"-like configuration. The device 200 has a base portion 202 that is configured to surround a metallic line 230 on the suction side of a compressor on an HVAC system for example, similar to what is discussed herein in connection with device 100 shown in FIG. 1 and FIG. 1A. In this embodiment, the base 202 of the device 200 has a thickness 204, length 206, and surface area 208. The device 200 also has a plurality of protrusions 210 that protrude from the base 202. Each of the protrusions 210 has a height 212, thickness 214, length 216 and surface area 218. The device 200 also has four walls 220 that create a "tub" or reservoir 222 for collecting fluid, such as water or metallic solution. The walls 220 have a thickness 224, length 226 and surface area 228. The base 202, protrusions 210 and walls 220 also have a plurality of holes 232 extending through the device 200. Each of the holes 232 has a hole surface area 234 and hole volume 236. When the holes 232 are positioned in the vertical direction, the holes 232 can form vertical capillaries 232A to hold and/or channel fluid. The protrusions 210, holes 232 or vertical capillaries 232A, and reservoir 222 of the anodic device 200 greatly enhance the overall surface area 238 and volume of the device 200 in combination with the volume and surface area of the base 208. The protrusions 210 can be elongated or otherwise shaped to increase the available surface area for condensation. The larger surface area of the device 238 will cause an overall increase in condensation on the surface of the device 200 in a given application particularly in the event the device 200 is placed in contact with a metallic line 230 or other surface that is colder than ambient temperature.

The objects subject to corrosion could be the metallic line 230 itself but could also be other internal or external components, or multiple internal or external components, of the HVAC system in electrical communication with the device 200 and/or line 230. That is, the device 200, while attached to or otherwise in electrical communication with the exterior line 230, could also be in electrical communication with internal components of the HVAC system that are also in electrical communication with the line 230.

By way of example, as shown in FIG. 2, and similar to what is shown in FIG. 1, the device 200 can connect with another virtually identical device 200A to fully surround the metallic line 230 in a collar-like fashion. The devices 200 and 200A may be connected to each other and to the line 230 in a multitude of ways, including, but not limited to, with nut and bolt assemblies.

As the device 200 (which is comprised of a metal that is dissimilar to the object or objects subject to corrosion) is placed in electrical communication with the surface of the metallic line 230, a potential difference is created between the dissimilar metals, causing corrosive current to flow to the device 200 from the line 230 and/or object subject to corrosion within the HVAC system, for example. Due to the unique configuration of the device 200, including the protrusions 210, increase in surface area of the device 200, holes 232 and reservoir 222, condensation on the surface of the device 200 is increased and promoted particularly in the event the device is mounted on a line 230 that is colder than ambient temperature. In this embodiment, condensation on the device 200 continuously accumulates on the surface of the device 200, including the protrusions 210, and drips down or is otherwise channeled into and stored in, at the least, the holes 232 and reservoir 222 of the device 200. This creates an active and continuous hydration system for the anodic device 200, and promotes water collection and storage while concomitantly providing multiple conduits for water to travel to the interface between the anodic device 200 and line 230, for example.

The perpetual supply of condensation and perpetual corrosion process synergistically enhances the overall effectiveness of the device 200. That is, the increase in condensation causes an increase in the ability of current to flow to the device 200 from the line 230 and/or object subject to corrosion such that the device 200 more readily corrodes than the object subject to corrosion. As corrosion of the device 200 continues metal atoms release from the device 200 and enter the condensation located on the surface of the device 200 and between the device 200 and surface of the line 230, creating a metallic solution that is increasingly conductive as the corrosion process continues. This increasingly enhances the current flow to the device 200 from the objects subject to corrosion, creating an enhanced sponge-like effect at the location of the device 200, thereby maximizing the protection of the objects subject to corrosion.

The configuration of the base 202, base thickness 204, base length 206, base surface area 208, protrusions 210, protrusion thickness 214, protrusion length 216, protrusion surface area 218, walls 220, wall thickness 224, wall length 226, wall surface area 228, reservoir 222, holes 232 and overall shape and configuration of the entire device 200, and materials used, may be selected according to numerous parameters including, but not limited to, what type of metal the device 200 is being attached to, what types of metal the objects subject to corrosion are made of, the location of the device 200 in relation to the location of the objects subject to corrosion, the environmental conditions, the overall parameters of a given application, and the desired life of the device 200, and so forth.

The anodic device 200 can be connected in the same fashion and used in the same way as device 100, as shown in FIGS. 1A and 1B.

Set forth below are specific examples of configurations of devices 200 according to the present invention. As indicated above, the devices 200 in the following examples could be made of metal or metal alloy, such as zinc, zinc alloy, magnesium, magnesium alloy, aluminum, and/or aluminum alloy.

Such materials could include, but are not limited to, MIL-A-19001K ASTM B418 Type I, MIL-A-24779 ASTM B418 Type II, Magnesium ASTM B-843, Zamak 2 ASTM AC43A, Zamak 3 ASTM AG40A, Zamak 4, Zamak 5 ASTM AC41A, Zamak 6 and Zamak 7 ASTM AG40B. Selection of the proper dissimilar anodic metal for the anodic devices would depend on what the objects subject to corrosion are made of, such that there is an appropriate difference in electrochemical potential between the anodic devices and the objects subject to corrosion causing the anodic devices to corrode and the corrosion of the objects subject to corrosion to be reduced.

Examples 6-10

| | Base Thickness | Base Width | Base Length | Arch Diameter | Protrusion Height | Protrusion Thickness | Protrusion Length | Surface Area | Hole Diameter | Wall Thickness | Wall Height | Wall Length |
|---|---|---|---|---|---|---|---|---|---|---|---|---|
| Example 7 | .30 | 1.8" | 3.0" | .375" | .56" | .20" | 1.3" | 35.75 inch$^2$ | .08" | .11" | .25" | 1.3" |
| Example 8 | .35" | 1.8" | 3.0" | .50" | .56" | .20" | 1.3" | 35.90 inch$^2$ | .08" | .11" | .25" | 1.3" |
| Example 9 | .18" | 1.8" | 3.0" | .625" | .56" | .20" | 1.3" | 36.00 inch$^2$ | .08" | .11" | .25" | 1.3" |
| Example 10 | .25" | 2.2" | 3.0" | .75" | .81" | .25" | 1.4" | 40.2 inch$^2$ | .08" | .18" | .32" | 1.9" |
| Example 11 | .25" | 2.2" | 3.0" | .875" | .81" | 25" | 1.4" | 40.2 inch$^2$ | .08" | .18" | .32" | 1.9" |
| Example 12 | .30" | 2.2" | 3.0" | 1.125" | .81" | 25" | 1.4" | 40.2 inch$^2$ | .08" | .18" | .32" | 1.9" |

Figure 3:
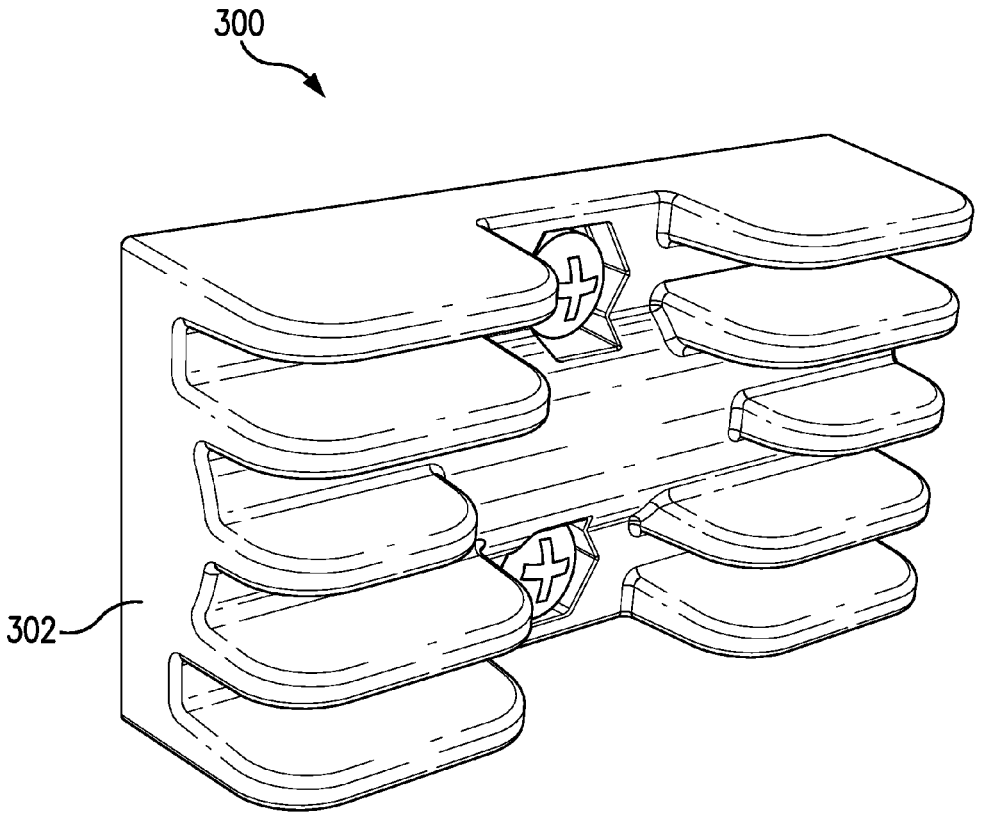
FIG. 3 is a perspective view of an anodic device for reducing corrosion in an object subject to corrosion in accordance with another embodiment of the present invention.
Figure 3A:
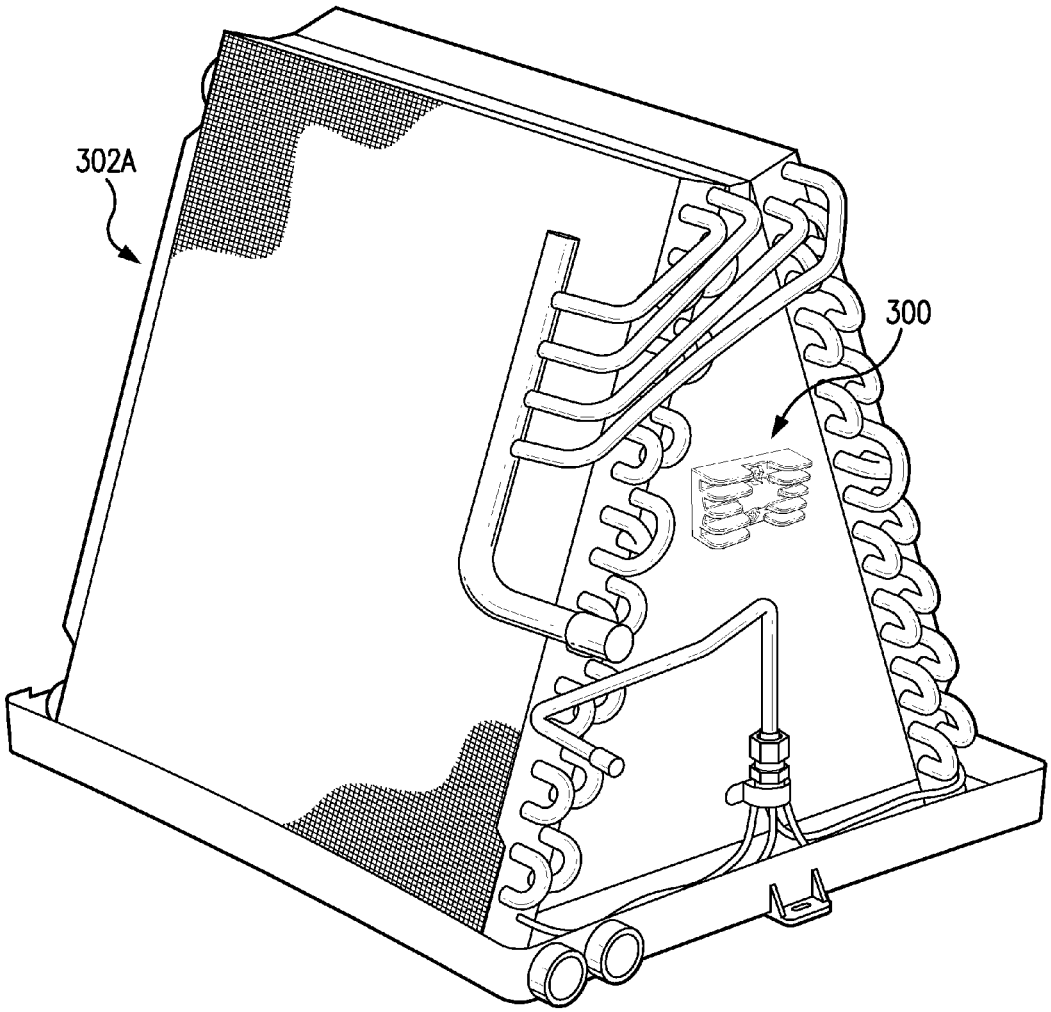
FIG. 3A is a perspective view of an anodic device for reducing corrosion used in conjunction with an A-Coil or evaporator in accordance with another embodiment of the present invention.

Referring now to FIG. 3, another anodic device 300 is shown. The device 300 has a substantially similar configuration, or could possibly have the same configuration, as the devices described above, but can also have a substantially flat base 302 (i.e. no "arch") and/or capable of being connected to a flat surface (rather than connected to a line as described above). Such an application may include, but not be limited to, bolting or screwing the device 300 to the flat side of an A-Coil 302A or evaporator of an HVAC unit, as shown in FIG. 3A.

Set forth below is a specific example of a configuration of a device 300 according to the present invention. As indicated above, the device 300 in the following example can be made of metal or metal alloy, such as zinc, zinc alloy, magnesium, magnesium alloy, aluminum, and/or aluminum alloy. Such materials could include, but are not limited to, MIL-A-19001K ASTM B418 Type I, MIL-A-24779 ASTM B418 Type II, Magnesium ASTM B-843, Zamak 2 ASTM AC43A, Zamak 3 ASTM AG40A, Zamak 4, Zamak 5 ASTM AC41A, Zamak 6 and Zamak 7 ASTM AG40B. Selection of the proper dissimilar anodic metal for the anodic device would depend on what the objects subject to corrosion are made of, such that there is an appropriate difference in electrochemical potential between the anodic device and the objects subject to corrosion causing the anodic device to corrode and the corrosion of the objects subject to corrosion to be reduced.

Example 11

| | Base Thickness | Base Width | Base Length | Protrusion Height | Protrusion Thickness | Protrusion Length | Surface Area |
|---|---|---|---|---|---|---|---|
| Example 11 | .48" | 2.0" | 3.0" | .56" | .14" | 1.1" | 23 inch$^2$ |

It will be appreciated that numerous other configurations of anodic devices are contemplated herein. Other configurations can be readily contemplated by the skilled artisan to most appropriately apply to the location where the anodic device 200 is to be placed on or within a given system.

Figure 4:
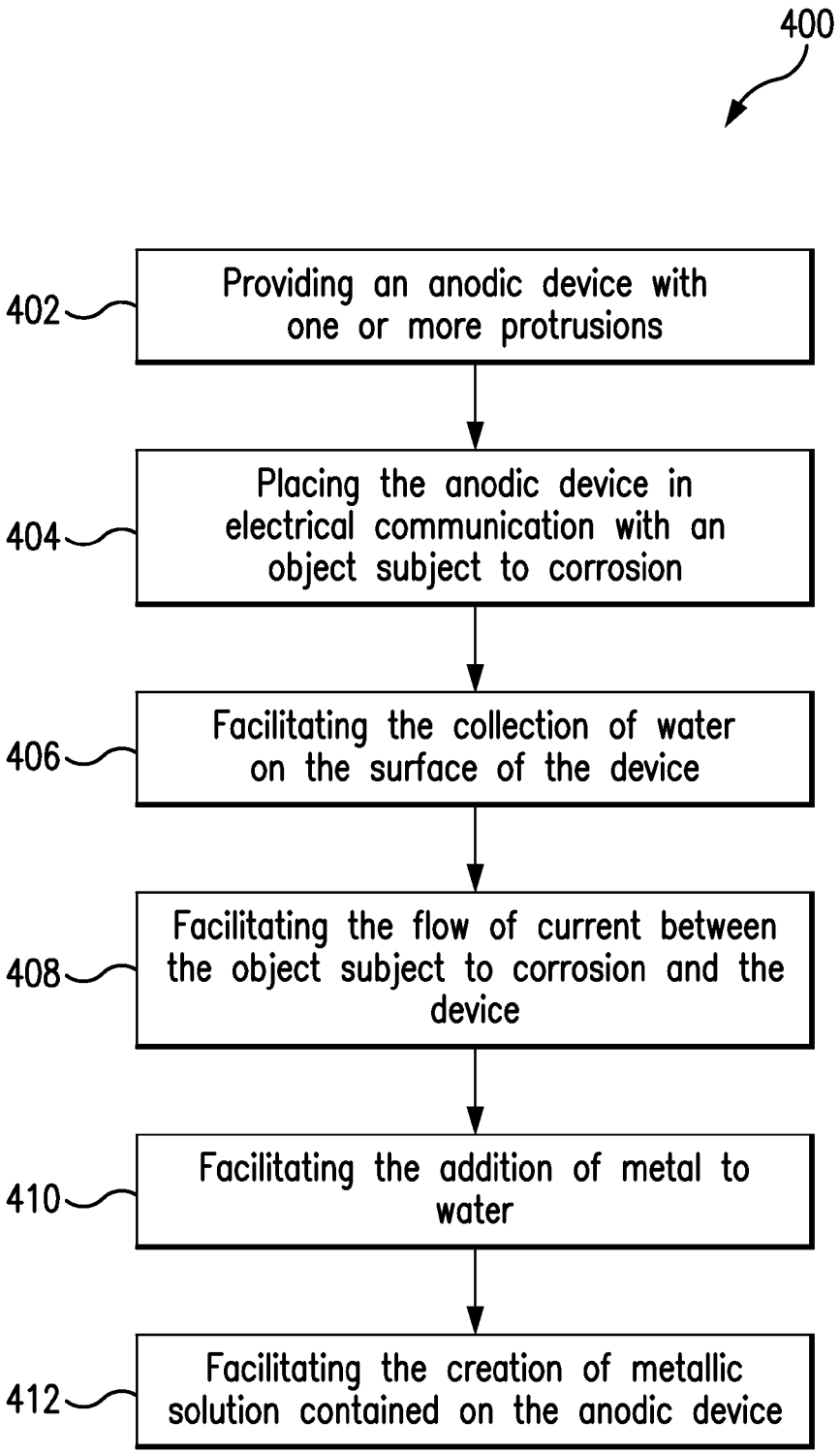
FIG. 4 is a flow chart illustrating a method for reducing corrosion in an object subject to corrosion in accordance with an embodiment of the present invention.

Referring now to FIG. 4, a flow chart 400 illustrating a method for reducing corrosion is shown. In the first step 402 of the method 400, an anodic device with one or more protrusions is provided. In step 404, the anodic device is placed in electrical communication with an object subject to corrosion. In step 406, the collection of condensation on the surface of the anodic device is facilitated. In step 408, the flow of current between the object subject to corrosion and the anodic device is facilitated such that the anodic device corrodes and reduces the corrosion of the object subject to corrosion. In step 410, the addition of metal to the water is facilitated. In step 412, the creation of a metallic solution contained on the anodic device is facilitated.

Figure 5:
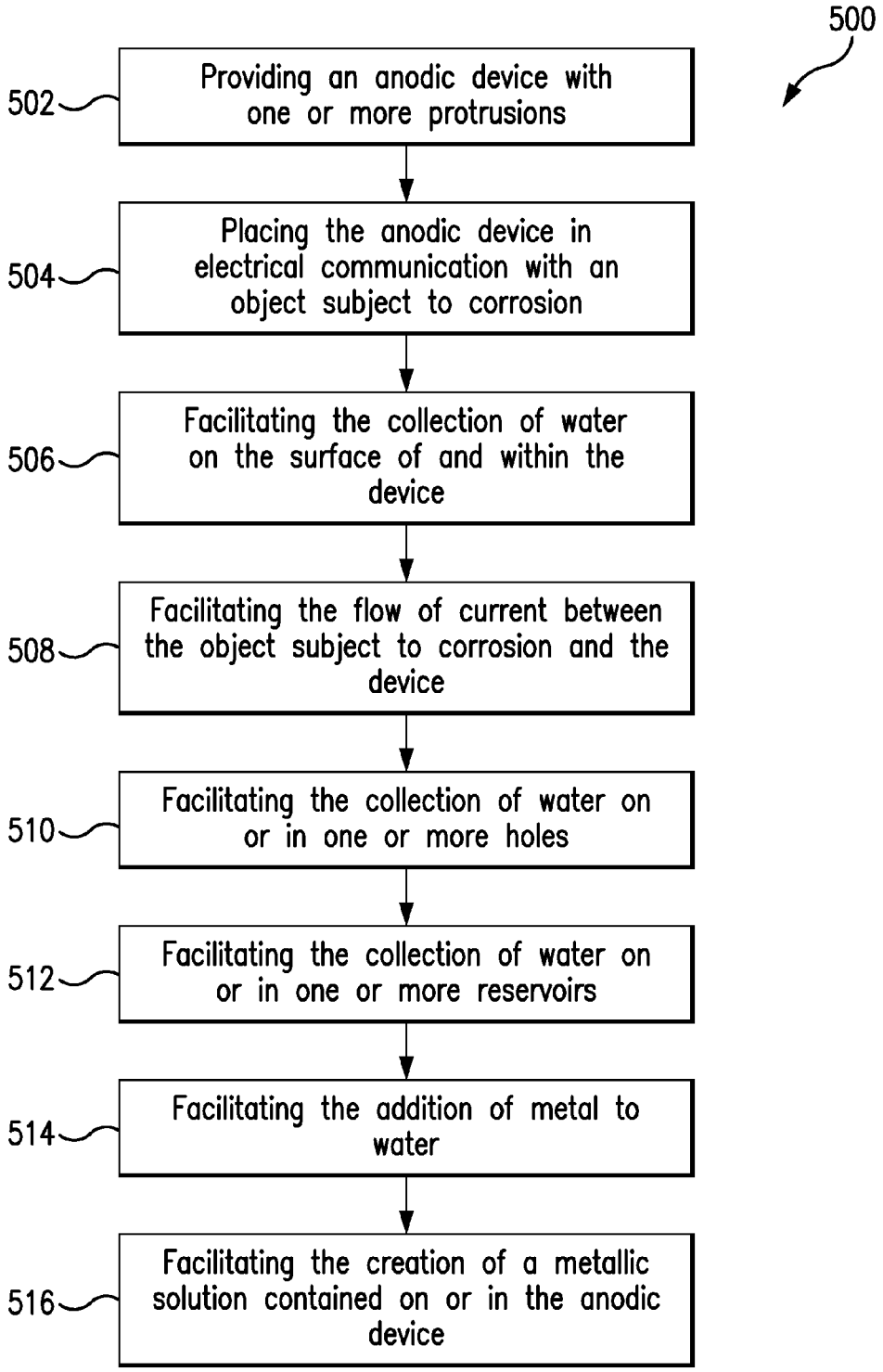
FIG. 5 is a flow chart illustrating a method for reducing corrosion in an object subject to corrosion in accordance with another embodiment of the present invention.

Referring now to FIG. 5, a flow chart 500 illustrating a method for reducing corrosion is shown. In the first step 502 of the method 500, an anodic device with one or more protrusions is provided 502. In step 504, the anodic device is placed in electrical communication with an object subject to corrosion. In step 506, the collection of condensation on the surface of and within the anodic device is facilitated. In step 508, the flow of current between the object subject to corrosion and the anodic device is facilitated such that the anodic device corrodes and reduces the corrosion of the object subject to corrosion. In step 510, the collection of water in one or more holes is facilitated. In step 512, the collection of water in one or more reservoirs is facilitated. In step 514, the addition of metal to the water is facilitated. In step 516, the creation of a metallic solution contained on or in the anodic device is facilitated.

While various embodiments have been described above, it should be understood that they have been presented by way of example only, and not limitation. Thus, the breadth and scope of the present disclosure should not be limited by any of the above-described exemplary embodiments. Moreover, any combination of the above-described elements in all possible variations thereof is encompassed by the disclosure unless otherwise indicated herein or otherwise clearly contradicted by context.

Additionally, while the methods described above and illustrated in the drawings are shown as a sequence of steps, this was done solely for the sake of illustration. Accordingly, it is contemplated that some steps may be added, some steps may be omitted, the order of the steps may be re-arranged, and some steps may be performed in parallel.

What is claimed is:

1. A method for reducing corrosion, said method comprising: providing an anodic device with a surface having one or more protrusions; placing said anodic device in electrical communication with an object subject to corrosion; providing a reservoir in said anodic device formed by a plurality of walls and a base from which the one or more protrusions protrude and are positioned such that water collected in said reservoir flows freely about said reservoir, wherein said reservoir is configured to collect water on the surface of and within said anodic device; and conducting the flow of current between said object subject to corrosion and said anodic device such that said anodic device corrodes more than said object subject to corrosion corrodes.

2. The method of claim 1, further comprising collecting said water on or in one or more holes.

3. The method of claim 1, further comprising creating additional metal in said collected water.

4. The method of claim 1, further comprising creating a metallic solution contained on or in said anodic device.

* * * * *